US011381032B2

(12) United States Patent
Pepe et al.

(10) Patent No.: US 11,381,032 B2
(45) **Date of Patent: *Jul. 5, 2022**

(54) ELECTRICAL PLUG CONNECTOR

(71) Applicant: CommScope Technologies LLC, Hickory, NC (US)

(72) Inventors: Paul John Pepe, Clemmons, NC (US); Neil Ktul Nay, Kernersville, NC (US); Brandon Eugene Bristow, Kernersville, NC (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/098,700

(22) Filed: Nov. 16, 2020

(65) Prior Publication Data

US 2021/0175662 A1 Jun. 10, 2021

Related U.S. Application Data

(63) Continuation of application No. 16/564,171, filed on Sep. 9, 2019, now Pat. No. 10,840,633, which is a (Continued)

(51) Int. Cl.
*H01R 13/56* (2006.01)
*H01R 24/64* (2011.01)
(Continued)

(52) U.S. Cl.
CPC ..... *H01R 13/562* (2013.01); *H01R 13/424* (2013.01); *H01R 24/64* (2013.01);
(Continued)

(58) Field of Classification Search
CPC .... H01R 13/562; H01R 13/424; H01R 13/41; H01R 13/465; H01R 13/506;
(Continued)

(56) References Cited

U.S. PATENT DOCUMENTS 4,569,566 A 2/1986 Triner
5,071,219 A 12/1991 Yurtin et al.
(Continued)

FOREIGN PATENT DOCUMENTS

CN 201199559 Y 2/2009
CN 202196954 U 4/2012
(Continued)

OTHER PUBLICATIONS

Extended European Search Report for Application No. 21168411.3 dated Jun. 28, 2021.
(Continued)

*Primary Examiner* — Briggitte R. Hammond
(74) *Attorney, Agent, or Firm* — Merchant & Gould P.C.

(57) ABSTRACT

An electrical plug connector terminates a twisted pair electrical cable. The electrical plug connector includes a base and a plug housing holding electrical contacts therebetween. The base includes a divider structure including separation walls. At least one of the separation walls defines an abutment surface against which a forward end of the electrical cable abuts when terminated by the electrical plug connector. The plug housing defines slots so that the electrical contacts are accessible. The electrical plug connector axially secures an outer jacket of the electrical cable against rearward movement relative to base. The at least one separation wall inhibits forward axial movement of the outer jacket of the electrical cable relative to the base.

20 Claims, 13 Drawing Sheets

Related U.S. Application Data continuation of application No. 15/751,400, filed as application No. PCT/US2016/046583 on Aug. 11, 2016, now Pat. No. 10,411,398.

(60) Provisional application No. 62/204,016, filed on Aug. 12, 2015.

(51) Int. Cl.

| | |
|---|---|
| ***H01R 13/424*** | (2006.01) |
| ***H01R 43/20*** | (2006.01) |
| ***H01R 13/46*** | (2006.01) |
| ***H01R 13/58*** | (2006.01) |
| ***H01R 13/506*** | (2006.01) |
| ***H01R 24/28*** | (2011.01) |
| ***H01R 13/41*** | (2006.01) |
| ***H01R 107/00*** | (2006.01) |

(52) U.S. Cl.

CPC ..... *H01R 43/20* (2013.01); *H01R 13/41* (2013.01); *H01R 13/465* (2013.01); *H01R 13/506* (2013.01); *H01R 13/582* (2013.01); *H01R 13/5841* (2013.01); *H01R 24/28* (2013.01); *H01R 2107/00* (2013.01)

(58) Field of Classification Search

CPC .. H01R 13/582; H01R 13/5841; H01R 24/28; H01R 24/64; H01R 2107/00; H01R 43/20

See application file for complete search history.

(56) References Cited

U.S. PATENT DOCUMENTS

| | | | |
|---|---|---|---|
| 5,505,638 | A | 4/1996 | Su et al. |
| 5,830,005 | A | 11/1998 | Watanabe |
| D402,266 | S | 12/1998 | Siemon et al. |
| 5,888,100 | A | 3/1999 | Bofill et al. |
| 5,899,770 | A | 5/1999 | Ezawa |
| 5,906,503 | A | 5/1999 | Wiencek et al. |
| D431,023 | S | 9/2000 | Yip et al. |
| D434,376 | S | 11/2000 | Connelly |
| 6,238,235 | B1 | 5/2001 | Shavit et al. |
| 6,250,949 | B1 | 6/2001 | Lin |
| 6,280,232 | B1 | 8/2001 | Beecher et al. |
| 6,319,048 | B1 | 11/2001 | Aekins et al. |
| 6,358,092 | B1 | 3/2002 | Siemon et al. |
| 6,402,559 | B1 | 6/2002 | Marowsky et al. |
| 6,406,325 | B1 | 6/2002 | Chen |
| 6,409,535 | B1 | 6/2002 | Marowsky et al. |
| D470,819 | S | 2/2003 | Sass et al. |
| 6,524,128 | B2 | 2/2003 | Marowsky et al. |
| 6,558,204 | B1 | 5/2003 | Weatherley |
| 6,579,116 | B2 | 6/2003 | Brennan et al. |
| 6,706,970 | B2 | 3/2004 | Laub et al. |
| RE38,519 | E | 5/2004 | Doorhy et al. |
| 6,729,901 | B2 | 5/2004 | Aekins |
| 6,739,898 | B1 | 5/2004 | Ma et al. |
| 6,783,402 | B2 | 8/2004 | Chen |
| 6,799,989 | B2 | 10/2004 | Doorhy et al. |
| 6,811,445 | B2 | 11/2004 | Caveney et al. |
| 6,846,197 | B2 | 1/2005 | Hirokawa et al. |
| 6,923,673 | B2 | 8/2005 | Doorhy et al. |
| 6,932,641 | B1 | 8/2005 | Liao |
| 6,955,557 | B2 | 10/2005 | Bernat et al. |
| 6,962,503 | B2 | 11/2005 | Aekins |
| 7,018,241 | B2 | 3/2006 | Caveney et al. |
| 7,033,219 | B2 | 4/2006 | Gordon et al. |
| 7,052,328 | B2 | 5/2006 | Ciezak et al. |
| 7,086,891 | B2 | 8/2006 | Liao |
| 7,114,985 | B2 | 10/2006 | Doorhy et al. |
| 7,168,994 | B2 | 1/2007 | Caveney et al. |
| 7,175,468 | B1 | 2/2007 | Chang |
| 7,220,149 | B2 | 5/2007 | Pharney |
| 7,229,309 | B2 | 6/2007 | Carroll et al. |
| 7,306,487 | B1 | 12/2007 | Chang |
| 7,335,066 | B2 | 2/2008 | Carroll et al. |
| D564,966 | S | 3/2008 | Shifris |
| 7,374,450 | B1 | 5/2008 | Chang |
| 7,374,458 | B2 | 5/2008 | Caveney et al. |
| 7,384,306 | B2 | 6/2008 | Malstrom et al. |
| 7,413,466 | B2 | 8/2008 | Clark et al. |
| 7,425,159 | B2 | 9/2008 | Lin |
| 7,479,025 | B2 | 1/2009 | Miller et al. |
| 7,556,536 | B2 | 7/2009 | Caveney et al. |
| 7,722,410 | B2 | 5/2010 | De Dios Martin et al. |
| 7,871,285 | B1 | 1/2011 | Tobey et al. |
| 7,874,865 | B2 | 1/2011 | Tobey |
| 7,914,331 | B2 | 3/2011 | Hetzer et al. |
| 7,959,475 | B2 | 6/2011 | Wellmann |
| 7,972,150 | B1 | 7/2011 | Lin |
| 7,972,183 | B1 | 7/2011 | Lin |
| 8,033,863 | B2 | 10/2011 | Gutter et al. |
| 8,043,124 | B2 | 10/2011 | Caveney et al. |
| 8,096,833 | B2 | 1/2012 | Tobey |
| 8,277,260 | B2 | 10/2012 | Caveney et al. |
| D674,347 | S | 1/2013 | Shifris et al. |
| 8,348,702 | B2 | 1/2013 | Lin |
| D676,384 | S | 2/2013 | Yang et al. |
| 8,388,386 | B2 | 3/2013 | Petersen |
| D684,537 | S | 6/2013 | Herink et al. |
| 8,480,438 | B2 | 7/2013 | Mattson |
| 8,574,000 | B1 | 11/2013 | Smith |
| D698,627 | S | 2/2014 | Chance et al. |
| 8,672,705 | B2 | 3/2014 | Schneider |
| 8,684,763 | B2 | 4/2014 | Mattson et al. |
| 8,690,593 | B2 | 4/2014 | Anderson et al. |
| 8,696,369 | B2 | 4/2014 | Mattson et al. |
| 8,702,444 | B2 | 4/2014 | Maranto et al. |
| 8,702,453 | B2 | 4/2014 | Caveney et al. |
| D705,731 | S | 5/2014 | Zhong et al. |
| 8,662,760 | B2 | 5/2014 | Cline et al. |
| 8,715,012 | B2 | 5/2014 | Taylor |
| 8,845,359 | B2 | 9/2014 | Taylor et al. |
| 8,992,260 | B2 | 3/2015 | Coffey et al. |
| 9,054,440 | B2 | 6/2015 | Taylor et al. |
| 9,093,796 | B2 | 7/2015 | Taylor et al. |
| 9,799,982 | B1 | 10/2017 | Lin |
| 2002/0142644 | A1 | 10/2002 | Aekins |
| 2002/0151208 | A1 | 10/2002 | Aekins |
| 2004/0121646 | A1 | 6/2004 | Iamartino et al. |
| 2005/0106929 | A1 | 5/2005 | Meckley et al. |
| 2011/0092100 | A1 | 4/2011 | Coffey et al. |
| 2011/0115494 | A1 | 5/2011 | Taylor et al. |
| 2012/0146660 | A1 | 6/2012 | Mattson |
| 2012/0315786 | A1 | 12/2012 | Lin |
| 2012/0329320 | A1 | 12/2012 | Taylor et al. |
| 2013/0084745 | A1 | 4/2013 | Siahaan et al. |
| 2013/0084746 | A1 | 4/2013 | Siahaan et al. |
| 2013/0157500 | A1 | 6/2013 | Mattson et al. |
| 2013/0280962 | A1 | 10/2013 | Fransen |
| 2014/0141630 | A1 | 5/2014 | Mattson |
| 2015/0207283 | A1 | 7/2015 | Guitard et al. |

FOREIGN PATENT DOCUMENTS

| | | | |
|---|---|---|---|
| CN | 202871999 | U | 4/2013 |
| CN | 202872068 | U | 4/2013 |
| CN | 103222127 | A | 7/2013 |
| CN | 103262353 | A | 8/2013 |
| CN | 102067388 | B | 11/2013 |
| CN | 103545664 | A | 1/2014 |
| CN | 203883207 | U | 10/2014 |
| EP | 1 858 117 | A1 | 11/2007 |
| JP | H10-134903 | A | 5/1998 |

OTHER PUBLICATIONS

International Search Report and Written Opinion of the International Searching Authority for corresponding PCT Patent Application No. PCT/US2016/046583 dated Nov. 18, 2016, 12 pages.

ELECTRICAL PLUG CONNECTOR

CROSS-REFERENCE TO RELATED APPLICATION

This application is a Continuation of U.S. patent application Ser. No. 16/564,171, filed on Sep. 9, 2019, now U.S. Pat. No. 10,840,633, which is a Continuation of U.S. patent application Ser. No. 15/751,400, filed on Feb. 8, 2018, now U.S. Pat. No. 10,411,398, which is a U.S. National Stage Application of PCT/US2016/046583, filed on Aug. 11, 2016, which claims the benefit of U.S. Patent Application Ser. No. 62/204,016, filed on Aug. 12, 2015, the disclosures of which are incorporated herein by reference in their entireties. To the extent appropriate, a claim of priority is made to each of the above disclosed applications.

BACKGROUND

Telecommunications cable lines are typically connected into port or jack terminals using plug connectors that enable the cables to be easily connected and disconnected. The cable lines are comprised of a number of wire pairs surrounded by a cable jacket. Quick connect cables are often constructed by securing a connector plug to the end of the cable wires and sliding the connector plug into a matching port terminal where it locks into place with a simple lever lock. An RJ45 type connector is one example.

Improvements are desired.

SUMMARY

Some aspects of the disclosure relate to an electrical plug connector configured to terminate an electrical cable. The electrical plug connector includes a base, a plug housing, and a strain-relief boot. The base includes a divider structure that defines a plurality of channels. The divider structure includes separation walls. At least one of the separation walls defines an abutment surface against which a forward end of the electrical cable abuts when terminated by the electrical plug connector. The plug housing defines an interior sized to receive a plurality of electrical contacts and a portion of the base. The plug housing defines slots so that the electrical contacts are accessible. The strain-relief boot defines a passage sized to receive the electrical cable. The strain-relief boot includes grip members configured to axially secure an outer jacket of the electrical cable against rearward movement relative to the strain-relief boot. The at least one separation wall inhibits forward axial movement of the outer jacket of the electrical cable relative to the base.

In certain implementations, the strain-relief boot is integrally formed with the base.

In certain implementations, the plurality of separation walls includes a first separation wall and a plurality of second separation walls. The second separation walls are orthogonal to the first separation wall. The at least one separation wall that inhibits forward axial movement of the outer jacket of the electrical cable is one of the second separation walls.

In certain examples, the first separation wall includes a forwardly extending flange coplanar with the first separation wall. The forwardly extending flange extends farther forwardly than the second separation walls. In an example, the forwardly extending flange extends between two adjacent ones of the second separation walls.

In certain implementations, the first separation wall extends between side walls of the base, wherein no other structure extends from the sidewalls to engage the electrical cable.

In certain implementations, the grip members define rearwardly facing ramps and forwardly facing shoulders.

In certain implementations, the grip members are disposed circumferentially around the passage defined by the strain-relief boot.

In certain implementations, the base includes a plurality of tabs having rearward facing shoulders and the plug housing defines openings having forward facing shoulders. The rearward facing shoulders of the tabs engage the forward facing shoulders of the openings to secure the plug housing to the base.

In certain implementations, the divider structure defines six channels.

In certain examples, the six channels are arranged in a top row of three channels and a bottom row of three channels. The channels in the top row are vertically aligned with the channels of the bottom row.

In certain implementations, a load bar configured to carry the plurality of electrical contacts. The load bar is sized to fit within the plug housing.

In certain examples, the base includes forward flanges that extend forwardly of the divider structure. The forward flanges being sized and spaced to abut a rearward-facing abutment surface of the load bar so that the forward flanges push the load bar within the plug housing towards slots defined in the plug housing when the base is pushed into the plug housing.

In an example, the forward flanges are sufficiently sized to inhibit pinching the conductors between the divider structure and the load bar. In an example, the abutment surface of the load bar is taller than a remainder of the load bar.

Other aspects of the disclosure relate to a base of an electrical plug connector including a strain-relief section and a manager section integrally formed with the strain-relief section and extending forwardly from the strain-relief section. The strain-relief section defines a passage sized to receive an electrical cable. The strain-relief boot includes grip members configured to axially secure an outer jacket of the electrical cable against rearward movement relative to the strain-relief boot. The manager section includes a divider structure that includes a first separation wall extending between opposing sidewalls. The divider structure also includes a second separation wall that extends orthogonal to the first separation wall. The second separation wall extends rearwardly of the first separation wall.

In certain implementations, flanges extend forwardly of the manager section, the flanges being coplanar with the opposing sidewalls.

Other aspects of the disclosure relate to a method of terminating an electrical cable having an outer jacket surrounding a plurality of twisted wire pairs. The method includes inserting an end of the electrical cable through a passage defined in a base until a forward end of the outer jacket abuts part of a divider structure of the base; routing twisted wire pairs through channels defined by the divider structure; inserting ends of the twisted wire pairs into the load bar; inserting electrical contacts into the load bar to make electrical contact with the twisted wire pairs; and pushing the load bar and electrical contacts into a plug housing using the base.

In certain implementations, routing the twisted wire pairs through the channels defined by the divider structure comprises routing one of the twisted wire pairs through a corresponding channel defined by the divider structure. In certain examples, the divider structure defines a top row of channels and a bottom row of channels. Routing the twisted wire pairs through the channels includes routing a twisted wire pairs through each channel in the top row and through only a middle channel in the bottom row.

DETAILED DESCRIPTION

The disclosure is directed to an electrical plug connector configured to terminate twisted pairs of conductors of an electrical cable. In certain implementations, the electrical plug connector includes an integral wire manager and boot. In certain implementations, the electrical plug connector includes a wire manager having dividing walls that inhibit forward axial movement of the electrical cable or jacket thereof. In certain implementations, the electrical plug connector includes a wire manager that includes forward flanges configured to push a load bar into position within a plug housing.

Figure 1:
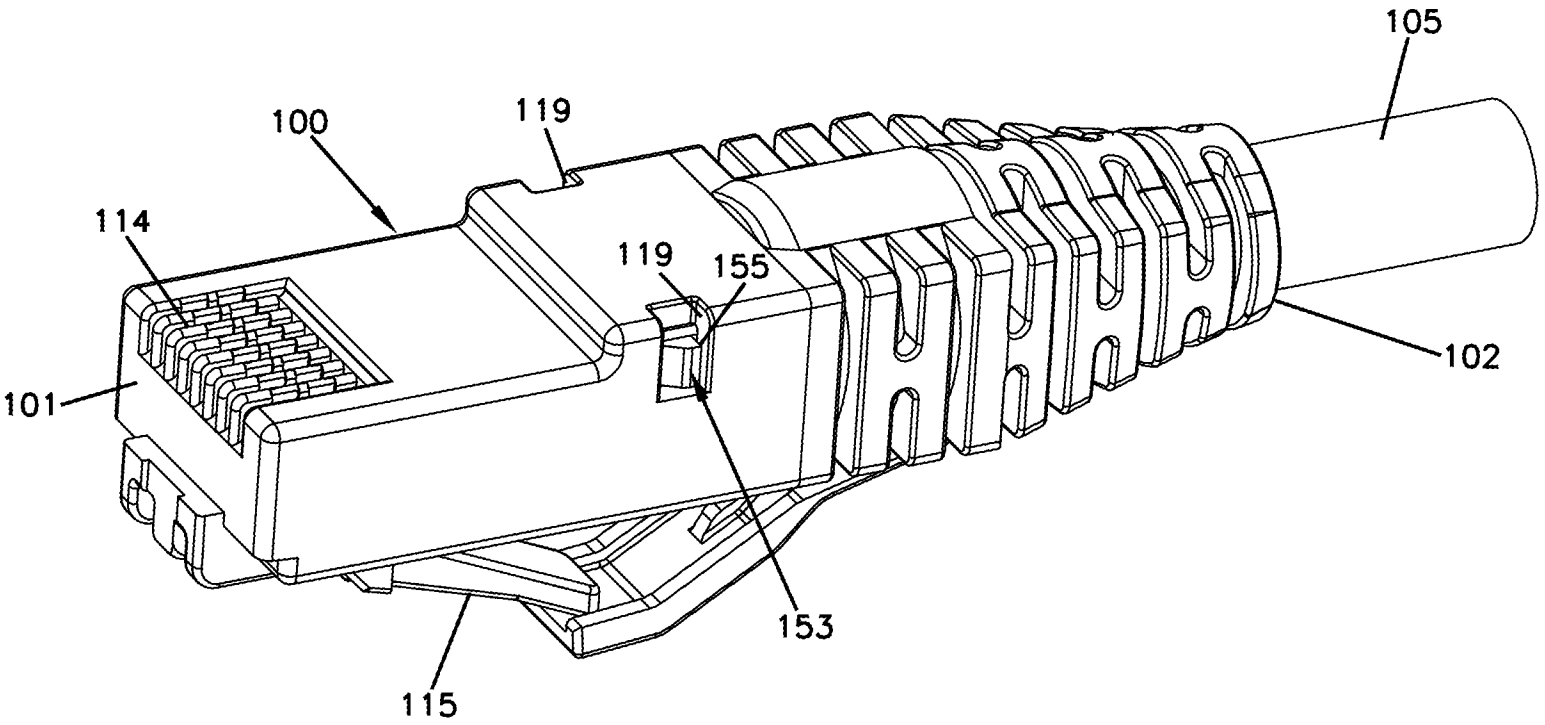
FIG. 1 is a perspective view of an example electrical plug connector configured in accordance with the present disclosure.
Figure 7:
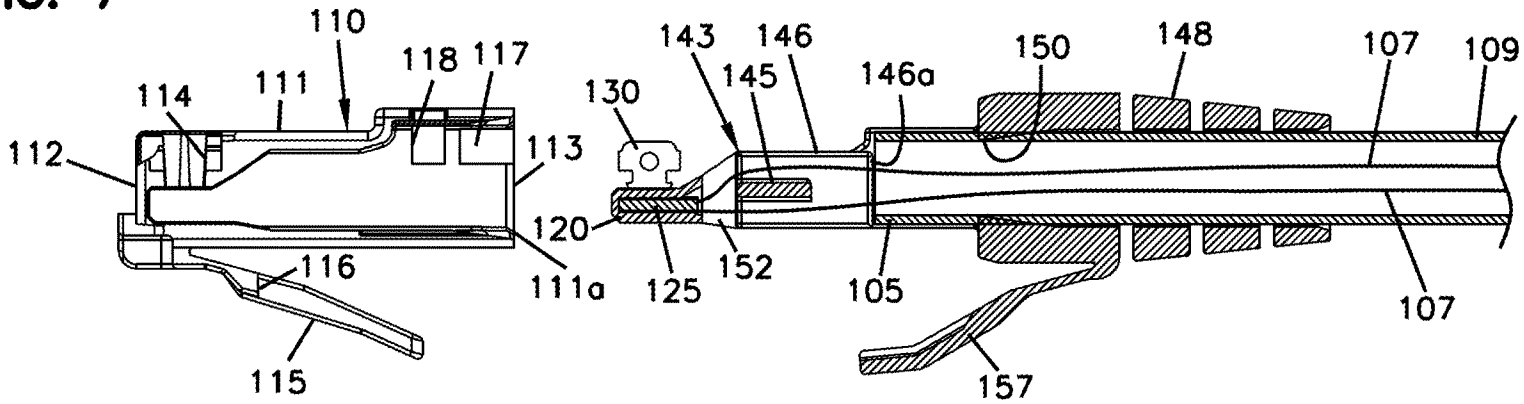
FIG. 7 is a longitudinal cross-sectional view of the electrical plug connector of FIG. 6 taken along the 7-7 line.
Figure 8:
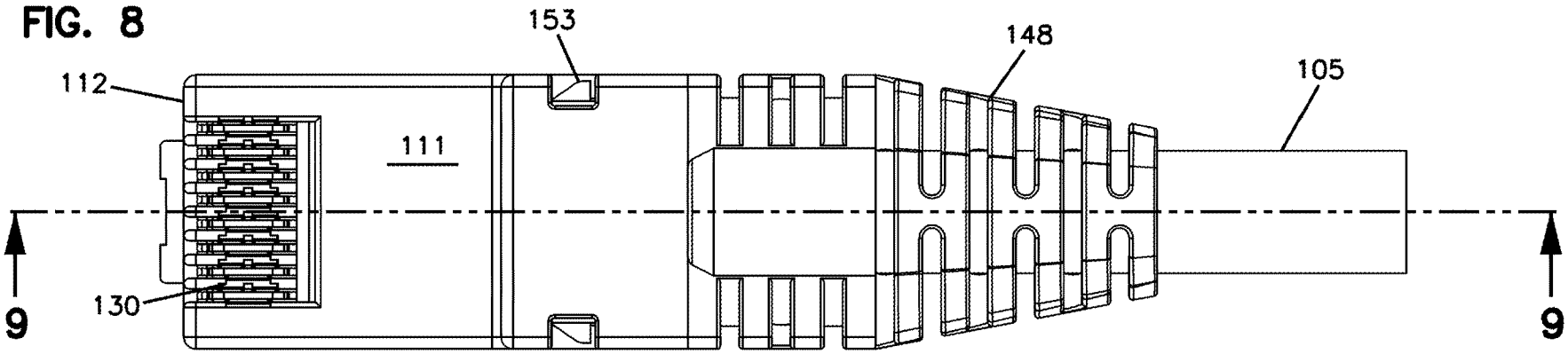
FIG. 8 is a bottom plan view of the electrical plug connector of FIG. 1.
Figure 9:
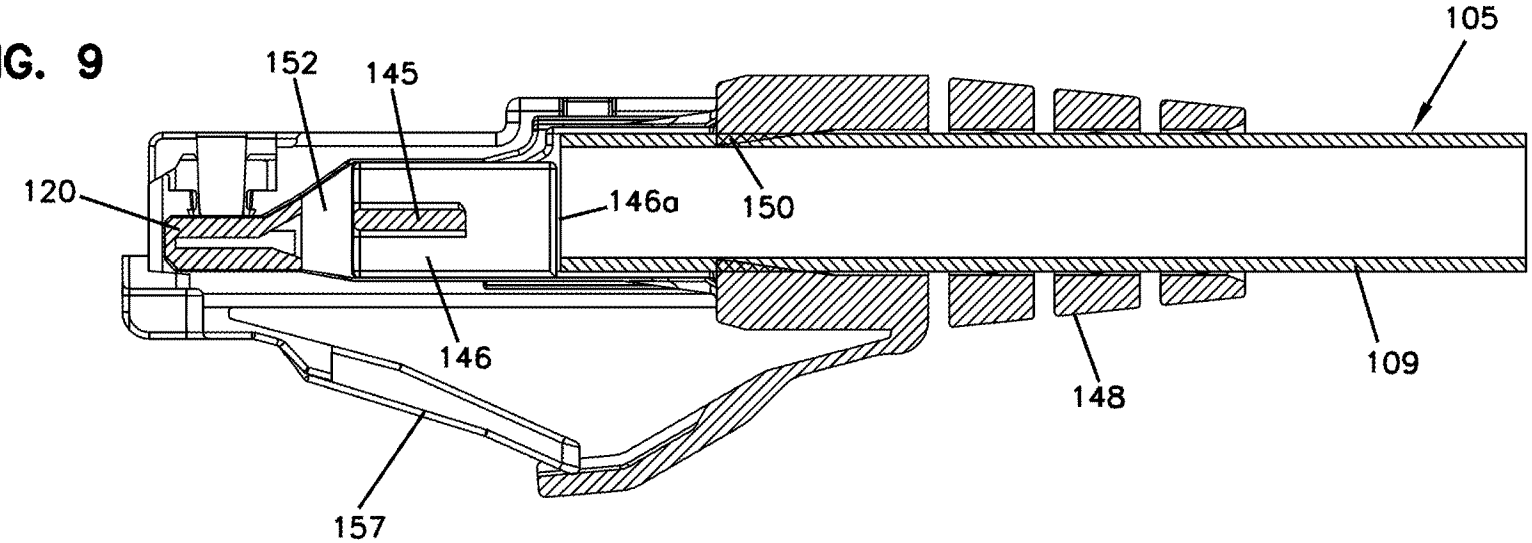
FIG. 9 is a longitudinal cross-sectional view of the electrical plug connector of FIG. 8 taken along the 9-9 line.

FIG. 1 illustrates an example electrical plug connector 100 configured in accordance with the principles of the present disclosure. The electrical plug connector 100 is configured to terminate an electrical cable 105. In particular, the electrical plug connector 100 is configured to terminate twisted pairs 107 (FIG. 7) of conductors of an electrical cable 105. The electrical plug connector 100 extends from a first end 101 to a second end 102. The electrical cable 105 extends into the electrical plug connector 100 at the second end 102. Twisted pairs 107 of conductors of the electrical cable 105 are routed through the electrical plug connector 100 to electrical contacts 103 towards the first end 101 (see FIG. 7).

Figure 2:
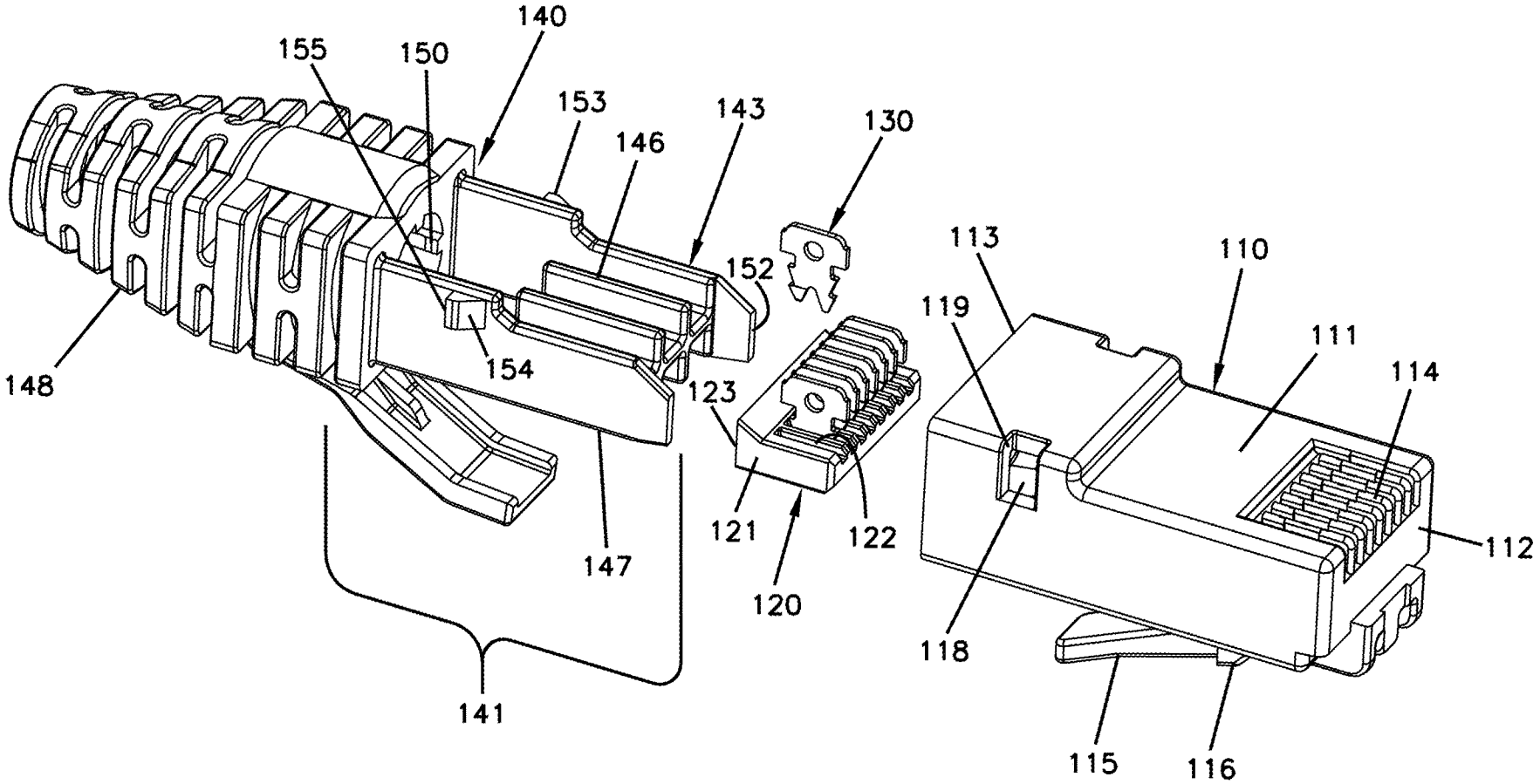
FIG. 2 is an exploded view of the electrical plug connector of FIG. 1.

As shown in FIG. 2, the electrical plug connector 100 includes a base 140, a load boar 120, multiple electrical contacts 130, and a plug housing 110. The load bar 120, the electrical contacts 130, and a portion of the base 140 are sized and shaped to fit within an interior of the plug housing 110 when the electrical plug connector 100 is assembled. In certain implementations, the base 140 includes a strain-relief boot 148 to provide strain-relief to the electrical cable 105. In certain implementations, the base 140 includes grip members 150 that inhibit axial and/or rotational movement the electrical cable 105 relative to the base 140.

To assemble the electrical plug connector 100, the electrical contacts 130 are positioned in the load bar 120. The electrical contacts 130 and the load bar 120 are pushed into an open rear of the plug housing 110 using the base 140. The base 140 is configured to axially secure to the plug housing 110 to hold the load bar 120 and electrical contacts 130 thereat.

The plug housing 110 includes a body 111 that extends from a closed forward end 112 to an open rearward end 113. The body 111 defines a plurality of slots 114 towards the forward end 112. The body 111 also defines a latching handle 115 having shoulders 116 configured to secure the electrical plug connector 110 at a receptacle (e.g., an electrical jack). The body 111 also defines latching openings 118 as will be described in more detail herein.

The load bar 120 includes a body 121 defining slots 122 sized to receive the electrical contacts 130. The load bar 120 is configured to carry the electrical contacts 130 when the electrical contacts 130 are disposed within the slots 122. The load bar body 121 is shaped to fit within an interior of the plug housing 110 so that the electrical contacts 130 align with the slots 114 of the plug housing 110. The load bar 120 also includes a rearward-facing abutment surface 123.

The base 140 includes a manager section 141 that organizes the twisted pairs 107 of conductors of the electrical cable 105. The manager section 141 includes a divider structure 143 that defines a plurality of channels 144 (see FIG. 5). In the example shown, the divider structure 143 defines six channels 144. In other examples, however, the divider structure 143 can define a greater or lesser number of channels 144. In an example, the divider structure 143 can define four channels 144. In another example, the divider structure 143 can define five channels 144. In another example, the divider structure 143 can define eight channels 144. In another example, the divider structure 143 can define four channels 144.

Figure 3:
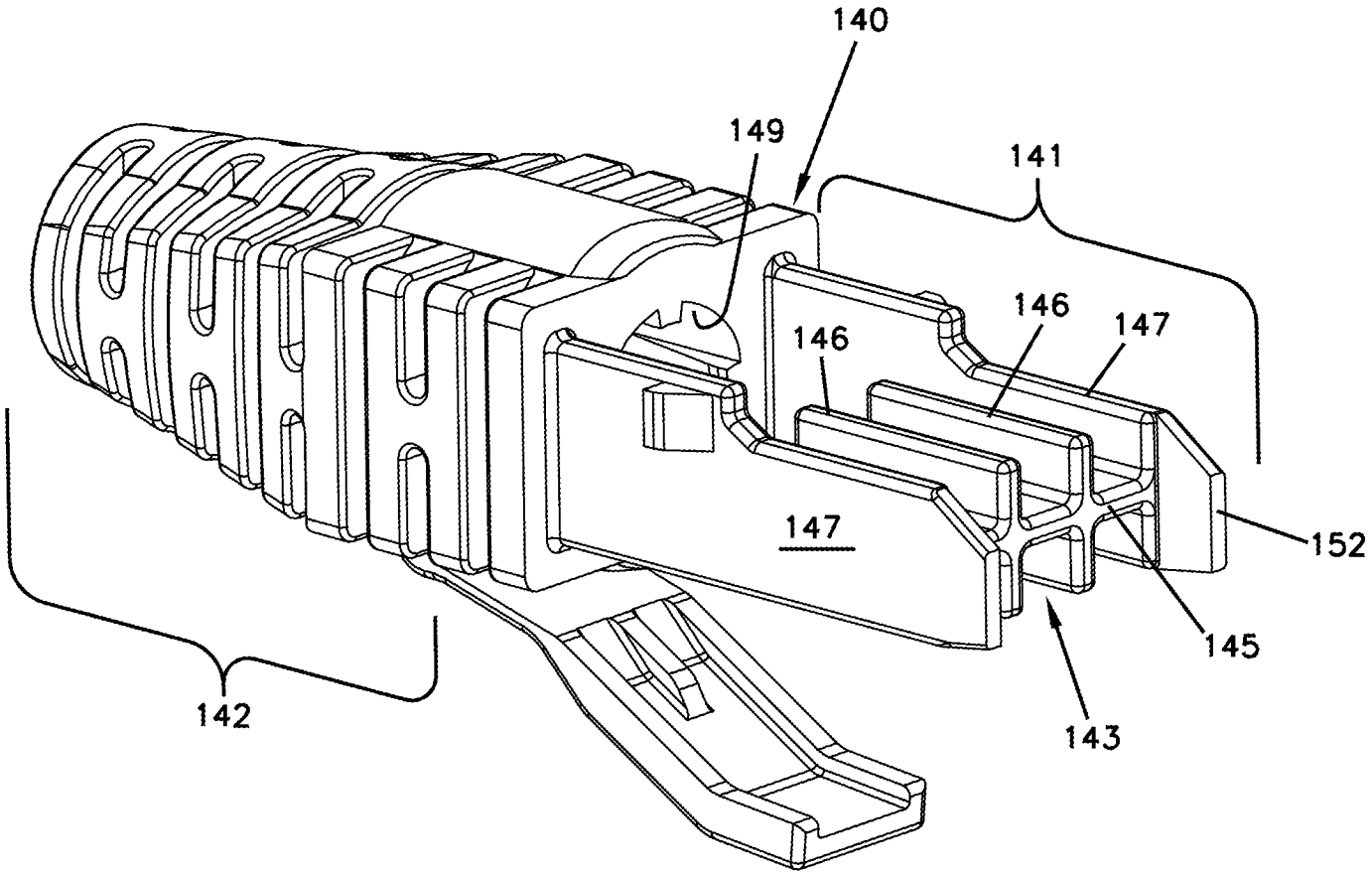
FIG. 3 is a perspective view of the wire manager of the electrical plug connector of FIG. 1.
Figure 4:
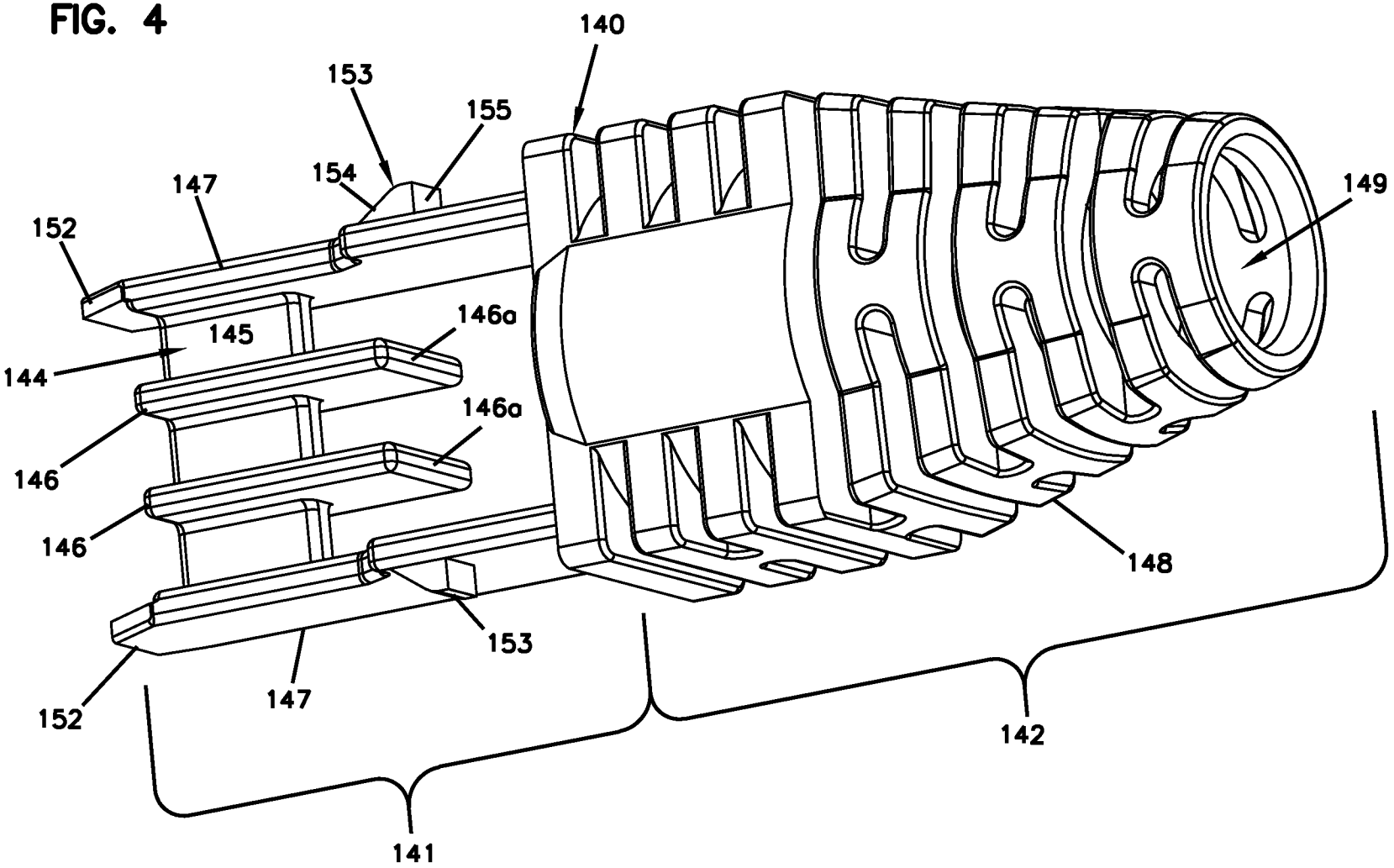
FIG. 4 is another perspective view of the wire manager of the electrical plug connector of FIG. 1.
Figure 5:
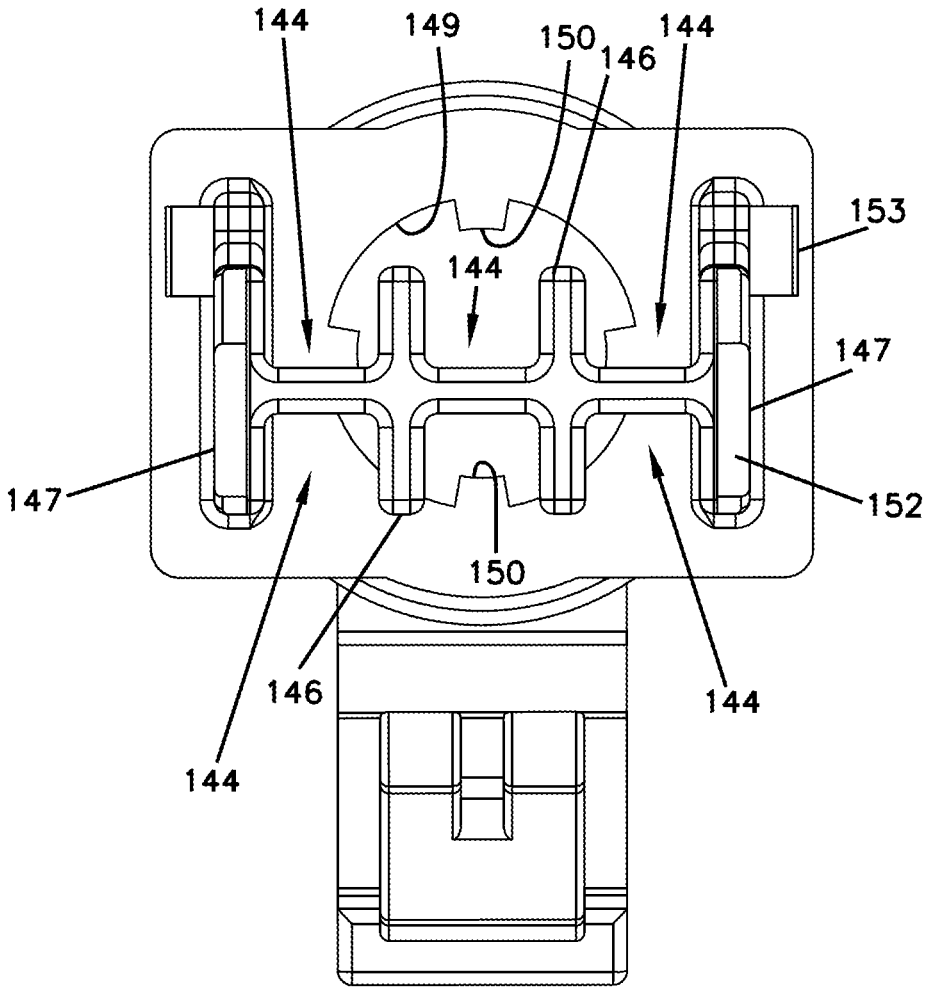
FIG. 5 is an end view of the wire manager of the electrical plug connector of FIG. 1.
Figure 6:
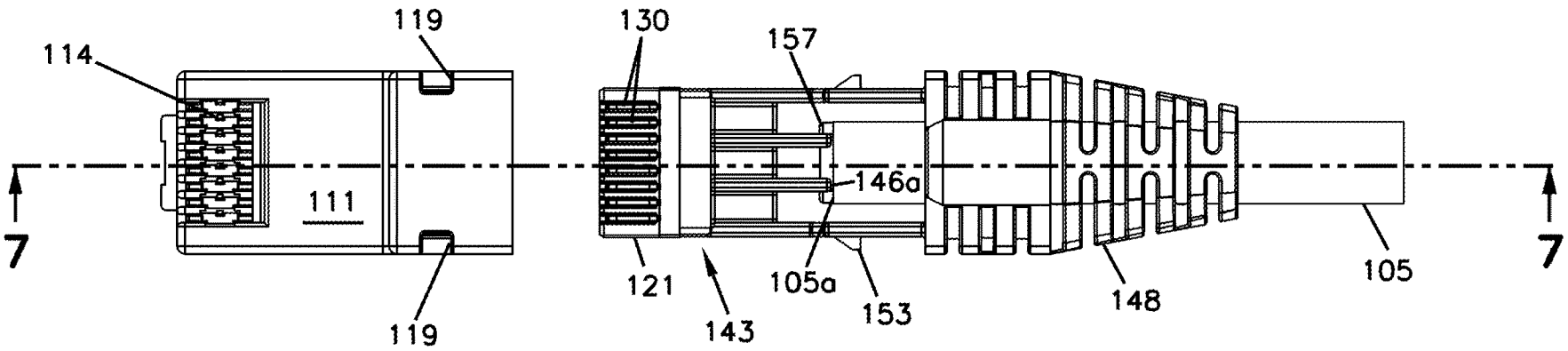
FIG. 6 is a bottom plan view of the electrical plug connector of FIG. 1 with a plug housing exploded forwardly of a remainder of the electrical plug connector.

As shown in FIGS. 3-5, the divider structure 143 includes a first separation wall 145. Some of the twisted pairs 107 of conductors are directed to one side of the first separation wall 145 and others of the twisted pairs 107 of conductors are directed to another side of the first separation wall 145 (see FIG. 7). The divider structure 143 also includes one or more second separation walls 146 that extend outwardly from the first separation wall 145. In the example shown, the second separation walls 146 extend orthogonal to the first separation wall 146. In certain implementations, side walls 147 are disposed at opposite ends of the first separation wall 145. In an example, the side walls 147 extend parallel to the second separation walls 145. The sidewalls 147 and second separation walls 146 cooperate to define the channels 144.

Figure 10:
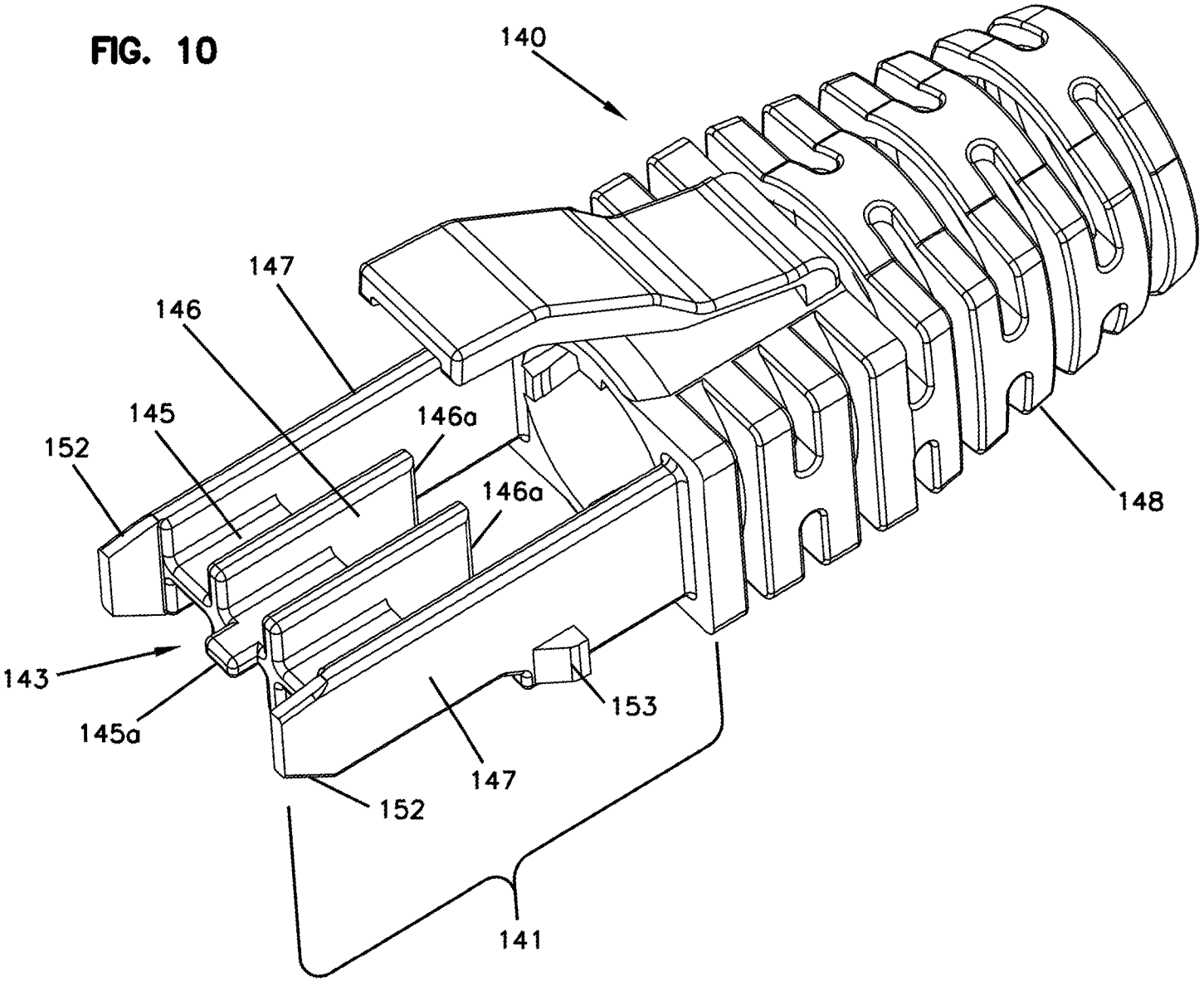
FIG. 10 is a perspective view of another example wire manager suitable for use in the electrical plug connector of FIG. 1.
Figure 11:
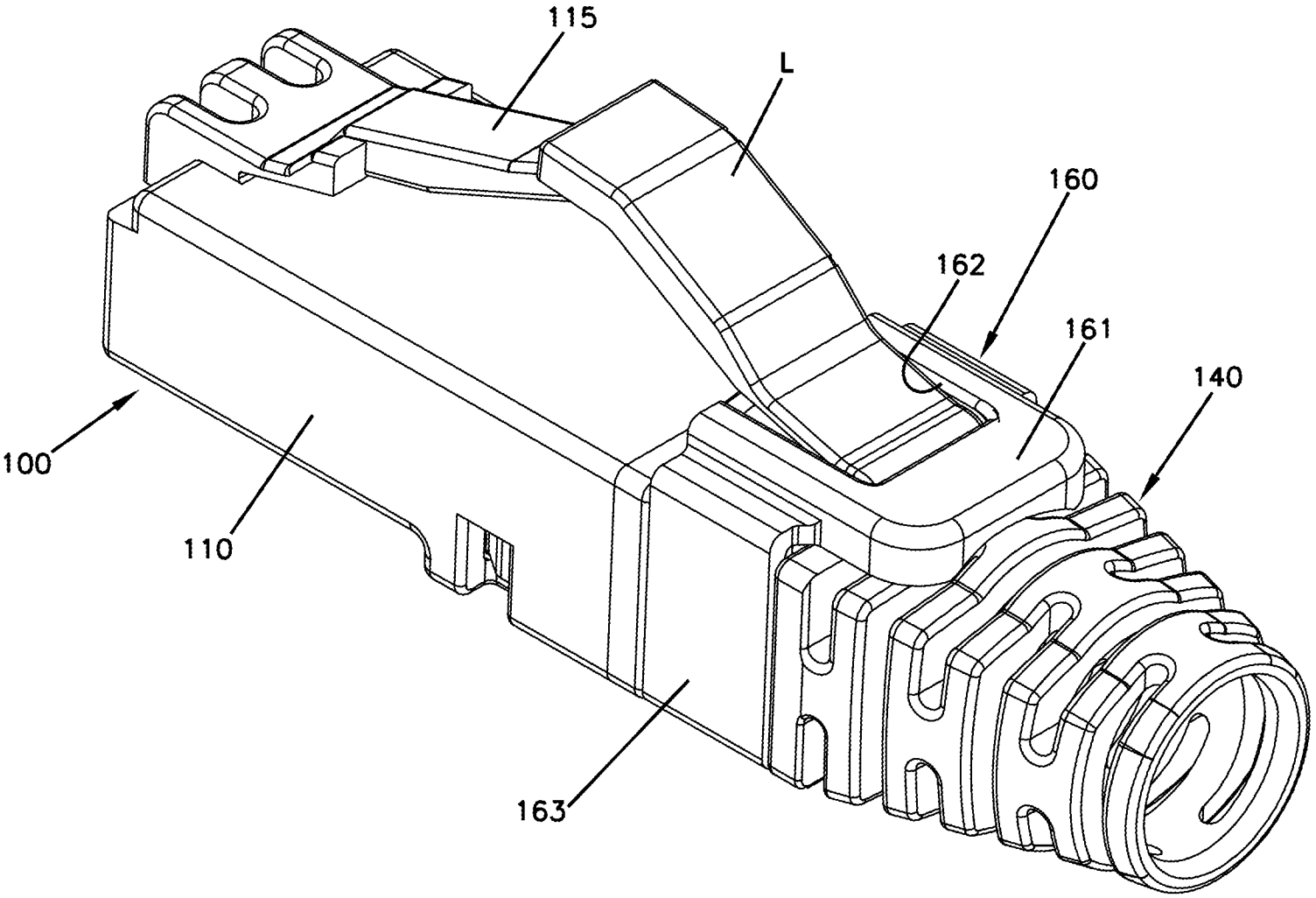
FIG. 11 is a perspective view of an electrical plug connector with a color-coded clip configured in accordance with the present disclosure.
Figure 14:
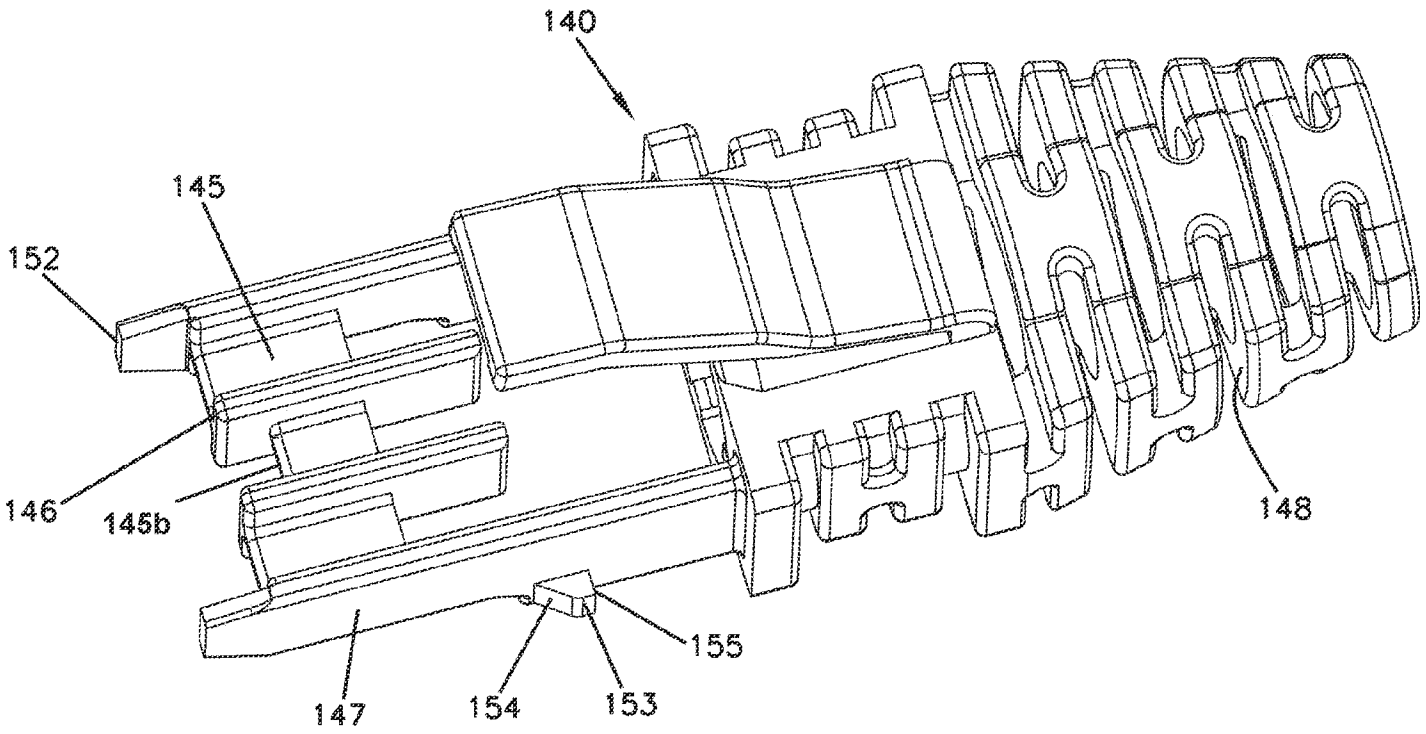
FIG. 14 is a perspective view of the boot of FIG. 13.

In certain implementations, the second separation walls 146 have rear-facing shoulders **146*a*. In certain implementations, the second separation walls 146 extend further rearward than the first separation wall 145 so that the rear-facing shoulders 146***a* are spaced rearward from the first separation wall 145 (see FIG. 4). In certain implementations, a flange 145*a* can extend forward of the first separation wall 145 (see FIG. 10). For example, the flange 145*a* can be planar with the first separation wall 145. In the example shown in FIG. 14, the first separation wall 145 defines a forward recess 145*b* between the second separation walls 146.

In certain implementations, the forwardly extending flange 145*a* facilitates maintaining separation of twisted pairs as the twisted pairs extend through the channels. In some examples, the forwardly extending flange 145*a* extends between two adjacent second separation walls 146 (see FIG. 10). In other examples, the forwardly extending flange 145*a* extends across at least a majority of a width of the first separation wall 145. In certain implementations, the second separation walls 146 are disposed further rearwardly than the first separation wall so that a section of the first separation wall 145 is disposed forward of the second separation walls 146. In certain examples, the second separation walls 146 extend further rearward than the flange 145*a* extends forward of the first separation wall 145.

In certain implementations, the base 140 also includes a strain-relief boot section 142 (FIG. 4). The boot section 142 includes a boot body 148 that defines a through-passage 149 sized to enable the electrical cable 105 to extend therethrough. An inner diameter of the through-passage 149 is sized so that an outer jacket 109 of the cable 105 extends fully through the boot body 148 and into the manager section 141 of the base 140 (see FIG. 7). In certain implementations, the outer jacket 109 of the cable 105 extends to the rear-facing shoulders 146*a* of the second separation walls 146 (see FIG. 7). In such implementations, the rear-facing shoulders 146*a* inhibit continued forward axial movement of the outer jacket 109.

In certain implementations, the boot body 148 includes one or more grip members 150 (see FIGS. 3, 5, and 7) disposed within the through-passage 149 to engage the outer jacket of the cable 105. Each grip member 150 includes a forward shoulder and a rearward ramp that bite into the outer jacket 109 of the cable 105. In certain examples, the grip members 150 inhibit rotational movement of the cable 105 relative to the base 140. In certain examples, the grip members 150 inhibit rearward axial movement of the cable 105 relative to the base 140. In the example shown, the boot body 148 includes four grip members 150 circumferentially spaced along the through-passage 149 (see FIG. 5). In other implementations, the boot body 148 can include a greater or lesser number of grip members 150.

In certain implementations, the base 140 includes forward flanges 152 that extend forwardly of the divider structure 143 (see FIG. 3). The forward flanges 152 are sized and spaced to abut the rearward-facing abutment surface 123 of the load bar 120. When the base 140 is pushed into the plug housing 110, the forward flanges 152 push the load bar 120 within the plug housing 110 towards the slots 114. In certain examples, the forward flanges 152 are sufficiently sized to inhibit pinching the conductors between the divider structure 143 and the load bar 120.

In certain implementations, the base 140 is configured to lock to the plug housing 110 in an axially and rotationally fixed position. In the example shown, the plug housing 110 defines holes 118 that have forward facing edges 119 (see FIG. 2). The base 140 includes tabs 153 that each have a forward ramp 154 and a rearward shoulder 155 (see FIG. 4). When the base 140 is inserted into the plug housing 110, the tabs 153 enter the holes 118 and the rearward shoulders 155 engage the forward facing edges 119 (see FIGS. 1 an 8). In other implementations, the base 140 may define the holes and the plug housing 110 may define the tabs. In still other implementations, the base 140 may otherwise secure to the plug housing 110.

In accordance with some aspects of the disclosure, an electrical cable is terminated by inserting an end of the electrical cable through a passage defined in a base until a forward end of the outer jacket abuts part of a divider structure of the base; and routing twisted wire pairs through channels defined by the divider structure. Ends of the twisted wire pairs are inserted into a load bar. Electrical contacts also are inserted into the load bar to make electrical contact with the twisted wire pairs. The load bar and electrical contacts are pushed into a plug housing using the base, thereby assembling an electrical plug connector.

In certain implementations, the twisted wire pairs are routed through the channels defined by the divider structure by routing each of the twisted wire pairs through a corresponding channel defined by the divider structure.

Figure 15:
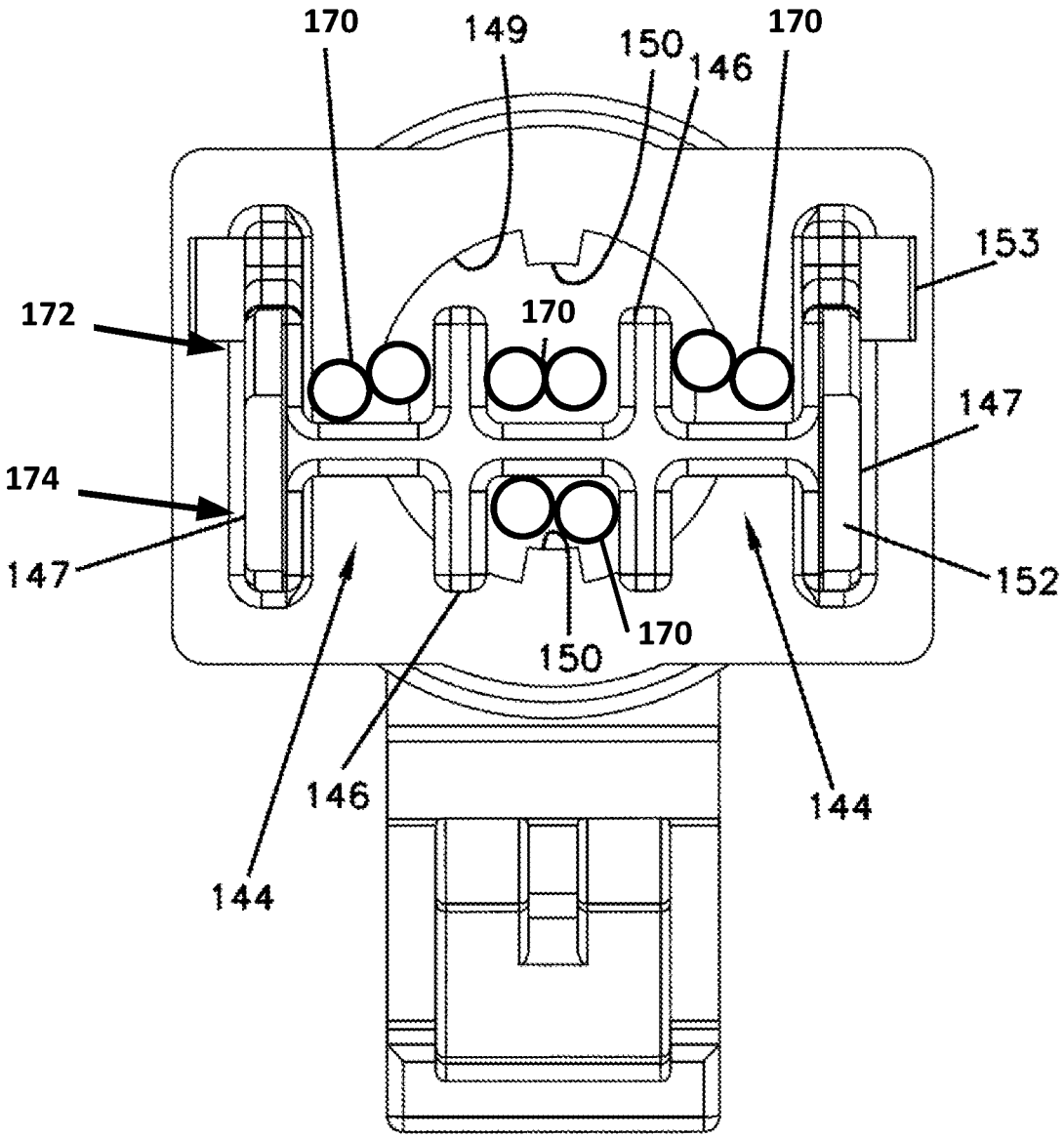
FIG. 15 is an end view of the wire manager of the electrical plug connector of FIG. 1 showing a plurality of wire pairs being routed through the wire manager.

In certain implementations, the divider structure 143 defines a top row 172 of channels 144 and a bottom row 174 of channels 144. In certain examples, the electrical cable includes four twisted wire pairs 170. In such examples, routing the twisted wire pairs 170 through the channels 144 includes routing a first of the twisted wire pairs 170 through a first channel 144 in the top row 172, a second of the twisted wire pairs 170 through a second channel 144 in the top row 172, a third of the twisted wire pairs 170 through a third channel 144 in the top row 172, and a fourth of the twisted wire pairs 170 through only a middle channel 144 in the bottom row 174 (see FIG. 15).

In certain examples, the electrical plug connector is an RJ45 connector.

In accordance with certain aspects of the disclosure, one or more color-coded features can be added to the plug or cable to identify one or more traits of the plug or cable. For example, the color-coded feature can identify whether the plug is shielded, the type of cable (e.g., number of jackets, number of twisted pairs, etc.), the diameter of the cable, the subscriber receiving the signals conveyed over the cable, etc.

FIGS. 11-14 illustrate an example clip 160 that can be mounted to the plug connector 100. In some implementations, the clip 160 can be mounted to a boot 140' of the plug connector 100. In other implementations, the clip 160 can be mounted to a plug housing 110 of the plug connector 100. In still other implementations, the clip 160 can be mounted to the cable.

In certain examples, the clip 160 is flush with the boot 140' on at least one side. In the example shown, the clip 160 is flush with the boot 140' on three sides. In certain examples, the clip 160 is flush with the plug housing 110 of the plug connecter 100. In the example shown, the clip 160 is flush with the plug housing 110 on three sides.

The plug housing 110 has a first side 110*a* and an opposite second side 110*b* that extend between a front and a rear of the plug housing 110. The plug housing 110 also includes opposite first and second ends that extend between the first and second sides 110*a*, 110*b* and between the front and the rear of the plug housing 110. The latching handle 115 is disposed at the first end and the slots 114 are accessible at the second end. In certain examples, the clip 160 does not extend beyond the first and second sides 110*a*, 110*b* of the plug housing 110 when mounted at the plug connector 100.

Figure 12:
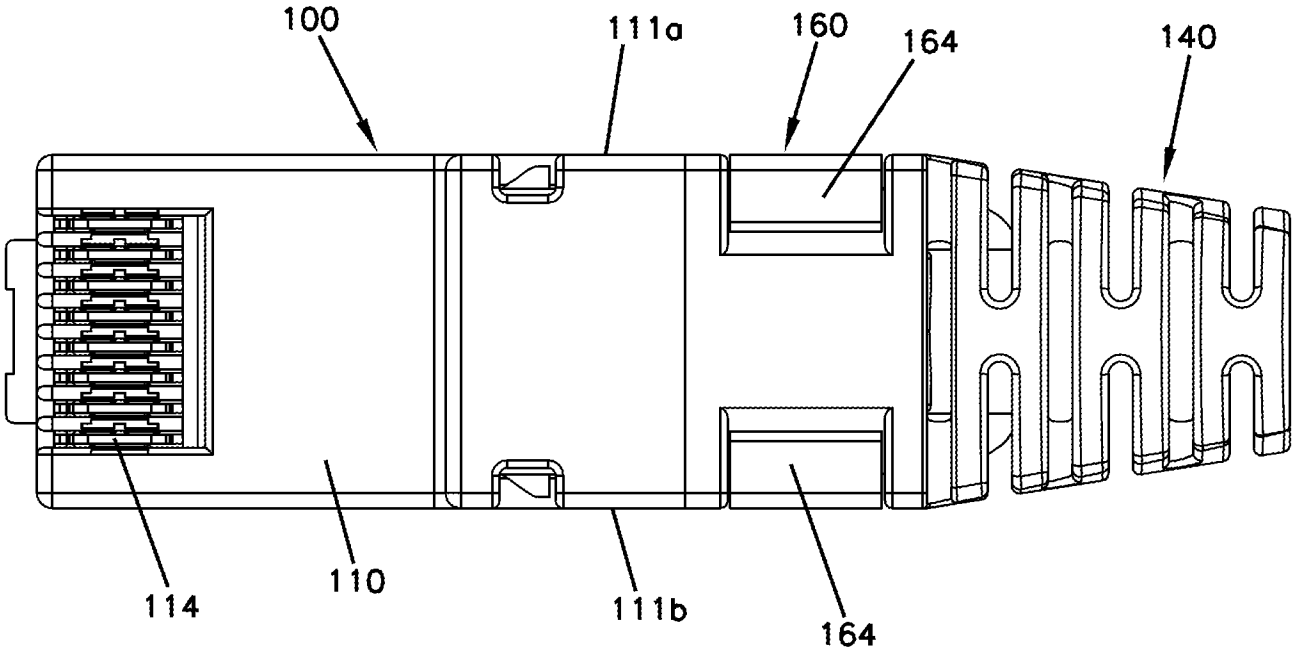
FIG. 12 is a plan view of the electrical plug connector of FIG. 11.
Figure 13:
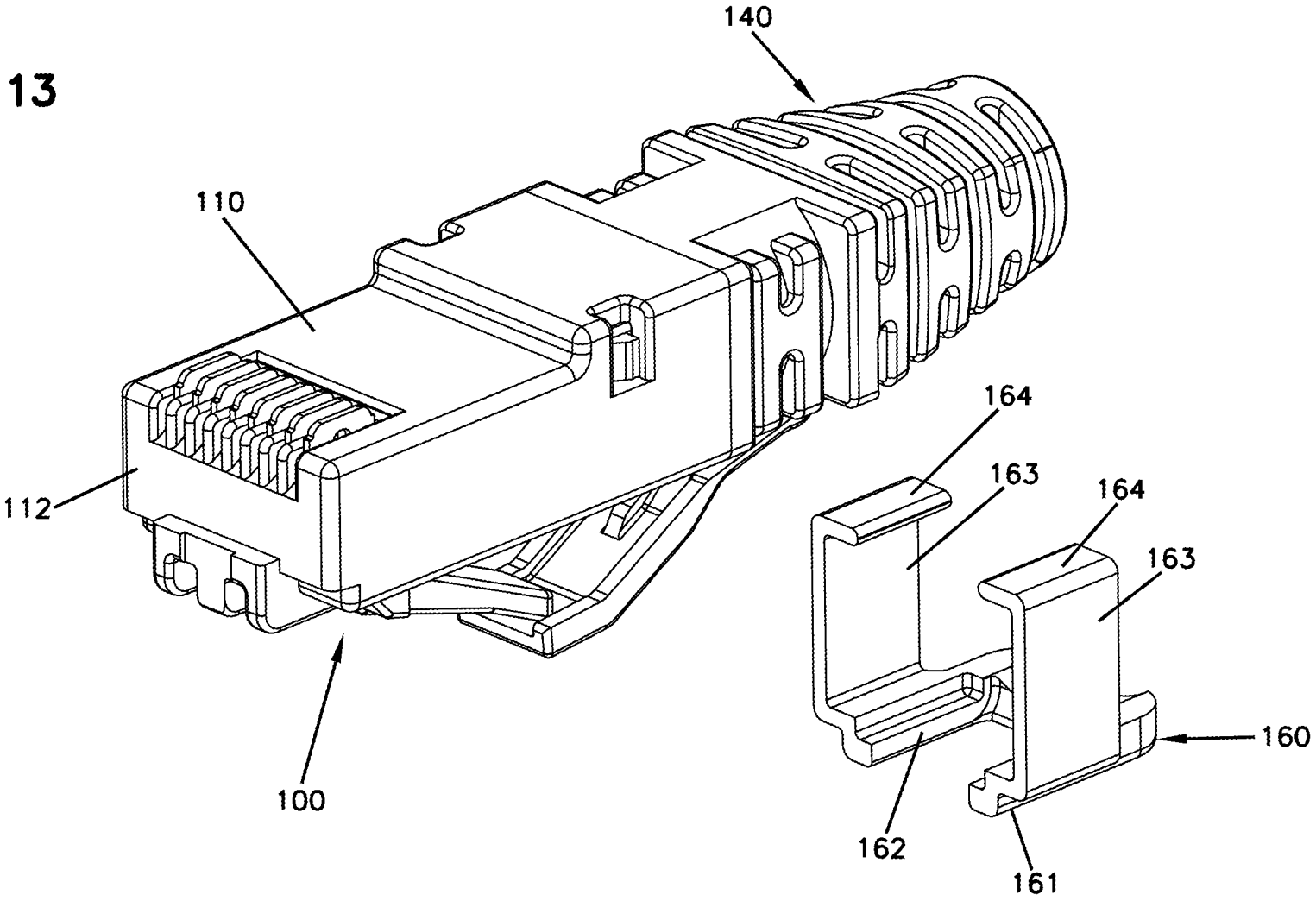
FIG. 13 is a perspective view of the electrical plug connector of FIG. 11 with the clip exploded from a boot of the electrical plug connector.

In the example shown in FIG. 12, the clip 160 is flush with the first and second sides 110*a*, 110*b* of the plug housing 110 when mounted at the plug connector 100.

In certain implementations, the clip 160 includes a base 161 having two flexible arms 163 extending outwardly therefrom to respective distal ends. Each of the arms 163 includes a latching member 164 at the distal end. In certain examples, the latching members 164 extend parallel with the base 161.

In certain implementations, the clip 160 wraps around and latches to the plug housing 110, boot 140, or cable. In certain examples, the base 161 defines a notch 162 to accommodate a latching assist arm L or other feature on the plug connector 100.

In some implementations, the entire clip 160 is uniformly colored. In other implementations, the base 161 of the clip 160 has a different color from the flexible arms 163.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. An electrical plug connector comprising:

a plug nose defining an interior accessible through an open end, the plug nose carrying electrical contacts accessible through slots disposed at an opposite end of the plug nose from the open end; and a wire manager configured to attach to the plug nose so that the wire manager is disposed within the interior of the plug nose, the wire manager including a first separation wall extending between opposite sidewalls of the wire manager, the wire manager also including a plurality of second separation walls extending orthogonal to the first separation wall to define a first row of wire management channels disposed above the first separation wall and a second row of wire management channels disposed beneath the first separation wall, the wire management channels of the second row being aligned with the wire management channels of the first row.

2. The electrical plug connector of claim 1, wherein each of the wire management channels is a same size as the other wire management channels.

3. The electrical plug connector of claim 1, wherein the first separation wall defines a forward recess.

4. The electrical plug connector of claim 3, wherein the forward recess is disposed between two adjacent ones of the second separation walls.

5. The electrical plug connector of claim 3, wherein the forward recess is disposed at a middle of the first separation wall between the opposite sidewalls.

6. The electrical plug connector of claim 3, wherein the wire manager includes flanges extending forwardly from the opposite sidewalls beyond the first separation wall.

7. The electrical plug connector of claim 1, wherein each of the first and second rows includes three wire management channels.

8. The electrical plug connector of claim 1, wherein the wire manager is formed integrally with a strain relief boot that remains external of the plug nose when the wire manager is attached to the plug nose.

9. The electrical plug connector of claim 1, further comprising latch members carried by the opposite sidewalls, and wherein the plug nose defines apertures sized to receive the latch members when the wire manager is mounted to the plug nose.

10. The electrical plug connector of claim 1, further comprising a load bar sized to be disposed within the interior of the plug nose when the wire manager is attached to the plug nose.

11. The electrical plug connector of claim 1, further comprising a cable extending through the wire manager, the cable including a plurality of twisted pairs extending through fewer than all of the wire management channels.

12. The electrical plug connector of claim 11, wherein the twisted pairs extend through all of the wire management channels of the first row and only one wire management channel of the second row.

13. An electrical plug connector comprising:

a plug nose defining an interior accessible through an open end, the plug nose carrying electrical contacts accessible through slots disposed at an opposite end of the plug nose from the open end;

a wire manager sized to fit within the interior of the plug nose when the wire manager is attached to the plug nose; and a strain-relief boot extending outwardly from the wire manager to a free end, the strain-relief boot remaining external of the plug nose when the wire manager is attached to the plug nose, the strain-relief boot defining a cable passage extending therethrough from the free end to a transition end at the wire manager, and the strain-relief boot including a plurality of grip members extending inwardly into the cable passage at the transition end.

14. The electrical plug connector of claim 13, wherein the grip members are equally spaced around a circumference of the cable passage.

15. The electrical plug connector of claim 13, wherein each grip member includes a forward shoulder and a rearward ramp.

16. The electrical plug connector of claim 13, wherein the wire manager includes a first separation wall extending between opposite sidewalls of the wire manager and a plurality of second separation walls extending above and below the first separation wall, the second separation walls extending further towards the strain-relief boot than the first separation wall.

17. The electrical plug connector of claim 13, wherein the strain-relief boot is integrally formed with the wire manager.

18. The electrical plug connector of claim 13, wherein the strain-relief boot defines a recessed section adjacent the transition end, the recessed section having at least one cross-dimension that is smaller than cross-dimensions on opposite ends of the recessed section.

19. The electrical plug connector of claim 18, further comprising a clip mounted to the strain-relief boot at the recessed section so that the clip is flush with the strain-relief boot on at least three sides of the strain-relief boot.

20. The electrical plug connector of claim 19, wherein the clip is color-coded.

* * * * *